United States Patent [19]

Franzmann

[11] Patent Number: 4,932,304

[45] Date of Patent: Jun. 12, 1990

[54] CONTROL DEVICE FOR THE MANUAL PLAYING OF ELECTRONIC MUSICAL INSTRUMENTS

[76] Inventor: Rainer Franzmann, Rehhagweg 9, 7800 Freiburg, Fed. Rep. of Germany

[21] Appl. No.: 42,225

[22] Filed: Apr. 15, 1987

[51] Int. Cl.[5] ..... G10H 5/00; G10H 1/32; G10H 1/34

[52] U.S. Cl. ..... 84/671; 84/644; 84/670; 84/718; 84/719; 84/720

[58] Field of Search ..... 84/1.01, 423, 423 B, 84/424, 425, 427, 1.17, DIG. 7, 1.19, 1.27, 1.13, 1.26, 615, 622, 626, 627, 644, 653, 658–659, 670, 692, 678, 687, 718–720, 671; 200/6 A; 340/706, 710; 273/148 B, 1 E

[56] References Cited

U.S. PATENT DOCUMENTS

| | | | |
|---|---|---|---|
| 4,123,960 | 11/1978 | Franzmann | 84/1.17 |
| 4,304,161 | 12/1981 | Franzmann | 84/1.01 |
| 4,462,294 | 7/1984 | Kazimer | 84/1.01 |
| 4,491,050 | 1/1985 | Franzmann | 84/1.01 |
| 4,653,375 | 3/1987 | Honda et al. | 84/1.17 X |

FOREIGN PATENT DOCUMENTS

| | | | |
|---|---|---|---|
| 2091470 | 7/1982 | United Kingdom | 84/1.01 |

*Primary Examiner*—A. T. Grimley

*Assistant Examiner*—Matthew W. Smith

*Attorney, Agent, or Firm*—Peter K. Kontler

[57] ABSTRACT

A manually played control device mounted on the playing board of an electronic keyboard instrument, to be played by one hand of a player while the other hand plays the main keys. The main keys produce usual control signals whereas the control device produces electrical control or sound signals for the variation, supplementing and completion of the control signals produced by the main keys. A plurality of continuous and/or gradual control signals can be played simultaneously for a subtle control and shaping of sound parameters, such as volume, pitch, timbre and noise, through the use of a control handle which is movable in several directions and in several planes and is sensitive to the variable load by the player's hand. Special keys on the playing board and on the control handle within the range of the fingers of the hand resting on the control handle serve to generate control signals and to initiate control functions provided by electronic means to improve, advance and simplify the foundations and possibilities of the playing technique. Different repetition and damping modes of tones and sounds played with the main keys can be played with the special keys. A plurality of distinct control functions can be initiated by the special keys without disturbing the flow of play.

12 Claims, 9 Drawing Sheets

CONTROL DEVICE FOR THE MANUAL PLAYING OF ELECTRONIC MUSICAL INSTRUMENTS

BACKGROUND OF THE INVENTION

The present invention relates to control devices for the manual playing of electronic musical instruments having a main key system and an additional control device for simultaneous playing actions with one hand of the player. The control functions and operations of these additional control devices render possible an accomplished and advanced playing in cooperation with the main keyboard. Such additional control devices will preferably be used on musical instruments which have been designed for live performance. Today, electronic musical instruments are able to produce almost every desired musical sound phenomena with regard to their advanced apparatus for sound generation and sound shaping. Advanced synthesizers, working with a digital generation and shaping of sound, may be mentioned as an example.

The musical sound phenomena which might be produced by those instruments depend crucially on the control devices which will be offered to the player for his playing and control actions. Control devices which can be considered as interfaces between the player and the apparatus for sound generation and sound shaping should be able to convert and transmit simultaneously a maximum number of distinct control data, thus enabling the player to be as free as possible in his musical aims and enable him to avoid instrumental restrictions which might limit his performing possibilities.

Whereas electronic musical instruments, which are designed for automatic sequencing and not for live performance, render possible nearly any desired complexity and accuracy of structural sound phenomena due to the fact that they can be programmed in a step by step mode, such instruments do not allow any authentical performance of sound parameters or sound phenomena which depend on spontaneous and genuine emotions of a performer.

But since an essential criterion of a superb musical performance is the genuineness of emotions, the control and playing elements of musical instruments for live performance must have a sublime and optimal architecture for a perfect playing technique which is not needed for instruments with automatic sequencing. The charm and the fascination of various historic musical instruments is primarily not given through the physical structure of their sounds, as for instance the structure of overtones, envelope curves etc., but rather through the subtle and refined action modes of their control features. Violins or wind instruments are an example. The high-tech facilities for sound generation and sound shaping are generally designed in a modular concept, the building blocks of distinct manufacturers being often compatible with each other. The so-called MIDI-standard, meaning musical instrument digital interface standard, improves the desired compatibility.

Therefore, devices for playing or controlling can be designed in solid separation from the sound generation and sound shaping equipment. Thus, actual examples of embodiment might be manufactured in one unit with the sound generation and shaping equipment, or, instead, as a control device without any sound equipment, but prepared for interconnection with commercial sound equipment and interfaces. This embodiment has the advantage that future sound equipment and the sound equipment of distinct manufacturers can be controlled by one and the same control device, provided that compatibility is furnished by a standardized interface, such as MIDI, for instance.

Known electronic keyboard instruments for live performance have a key system which generally consists of upper black keys and lower white keys, a key system which is identical or nearly identical with that of historical organs or pianos. For the most part the selection of tone degree, the attack of sound, the dynamic and the damping of sound will be controlled with such a key system. For the control of further, supplementary sound parameters further control devices for one-hand playing have been added; so-called modulation wheels, joysticks, ribbon manuals; or pedals or levers to be operated by a player's foot or knee; or so-called breath-controllers being played with the player's mouth. These known additional control devices have various disadvantages. Modulation wheels render possible the control of a single sound parameter, the bending of the pitch, for instance.

Joysticks often showing a movability in all three spatial dimensions and with that allowing simultaneous control of three sound parameters, provide, as a result of their three-dimensional movability, a very difficult playing technique when a simultaneous control of all three sound parameters is required.

Pedals or levers for foot or knee generally serve to control the volume and/or timbre. These modes of control are very unwieldy and have therefore only little suitability for subtle control actions. The advantage that both hands of the player may be saved for playing actions on the main keys is neutralized through the disadvantage that the foot of the player cannot be used for other important purposes, such as the control of organ-like tone pedals, for instance.

Breath-controllers, applied to the musical instruments "Variophon" and "Lyricon", for instance, present generally a combined control of several sound parameters which are dependent upon each other, similar to those of acoustic wind instruments. The continuous control of volume, pitch and timbre can only be done in a composite mode. If such breath-controllers will be mounted on the table of a keyboard instrument and further will be oriented to the player's face, both hands of the player will be available for any desired action, but the posture of the player will be extremely fixed, this being very disadvantageous. If breath-controllers are used, singing at the same time is impossible, of course. The hygienic problems of breath-controllers are not to be neglected.

Another attempt to place a maximum number of simultaneously functioning control elements at a player's disposal has been described in U.S. Pat. No. 4,123,960. A serious disadvantage of the playing devices described therein is that the main keys, which control the tone degree, the attack of sound, the dynamic of sound and the damping of sound, have been miniaturized too much in order to be able to place them on a frame unit which can be moved in X-direction on the playing board. Such miniaturizing provides a very difficult playing technique, with regard to a reliable fingering of sequences of tones for chords. Furthermore, the frame unit with all its elements provides too much inertia, thus rendering difficult a suitable playing technique for the control of a continuous pitch variation, which depends on a free movability of the frame unit. Another important disadvantage is that the playing actions on the main keys will disturb other playing actions done with the same hand of the player.

It is an object of the invention to eliminate the above mentioned disadvantages and to design a manual control equipment which consists of a main key system and an accompanying additional control device and renders possible a maximum number of simultaneous and autonomous controls of sound parameters and/or playing aids, thus providing a playing technique with simple, reliable and clearly arranged playing actions for real time or live performance.

This object is achieved in that a main key system is arranged on a playing or control table and, at a short distance from the main key system but separated from it in its mechanical functions, a control handle is placed on the playing board. This control handle is movable in one or more planes or directions and is designed to be contacted and guided by one hand of the player. If the player moves and/or stresses it, mechanical-electric converters which are operatively connected with the control handle, will produce or will control electric signals in a continuous or gradual mode. Furthermore, several special keys and one or more turning or sliding knobs are placed on the playing board within the action range of the fingers of the player's hand which contacts the control handle. The special keys and turning or sliding knobs render it possible to control additional electric signals and/or playing functions. According to the invention, it is assumed that the main key system which has to cooperate with the additional control device, might be designed in the same way as the common piano key system with its upper and lower keys, or, instead of that, it might also be designed as a key system of the type described in German Pat. application No. 34 34 160.9, both key systems being arranged for the control of tone degree, attack of sound, dynamic of attack and damping of sound. Since the additional control device of the invention has to render possible the control of all additional requested sound parameters and other playing functions, such as playing aids, it will be necessary that one hand of the player be entirely devoted to that additional control device. It is preferred that the left hand is used to manipulate the additional control device, whereas the right hand plays the main key system.

It follows from this that, if the additional control is used, a two-handed playing mode on the main keys will be lost, this being a considerable limitation of the practical performances in the polyphonic domain. Therefore, the additional control device of the present invention has been designed in such a manner that both legs and feet of the player can be used for an unrestricted control of a foot-controlled musical instrument, as described for example in U.S. Pat. No. 4,491,050 which means that these leg and foot operated members do not control entirely or partly sound parameters and/or playing functions of the manual range. The foot-controlled musical instruments, but likewise tone pedals with the common architecture, render possible practical performances together with the mentioned main key systems which are almost equal to that of a two-handed performance in the field of polyphonics. It is obvious that keyboard instruments, featuring the additional control device of the invention, will allow a two-handed playing mode as soon as it is required. But musical performances which require a subtle shaping of sound parameters, for instance, have to be played together with the additional control device. The placement of the additional control device on the playing board will be arranged in such a way that a two-handed playing on the main keys will be possible without any restriction.

To simplify the description of the geometrical or spatial relations, the X, Y, Z coordinate system will be used. The X-axis is horizontal and extends in the longitudinal direction of the keyboard; the Y-axis is horizontal and normal to the X-axis; the Z-axis is normal to the X-Y plane.

The additional control device of the invention serves to complement and control the sound parameters belonging to tones or sounds which have been played with the main keys, and furthermore, to control supplement or substitute sound parameters, and additionally serves to improve and simplify the playing actions on the main keys, avoiding thereby any interruption of the flow of the playing.

The control handle, the movable bearings and mounting components of which are placed inside the playing board, has an upper part, which is mounted above the top surface of the playing board and serves to be contacted by and as a seat for the player's hand, preferably the palm of the hand. The mechanical supporting means are dimensioned in such a manner that the weight of the player's arm and additional forces will be supported without any risk for their carrying capacity and their technical functions. The level of the upper part related to the top surfaces of the main keys is designed in such a manner that any restriction for a two-handed playing on the main keys is avoided, this being achieved through appropriate shaping of the surface of the playing board. The upper part is preferably designed like a grip and its length preferably corresponds to the average width of a human hand and its longitudinal axis is oriented in X-direction and parallel or nearly parallel to the top surface of the playing board. Within the action range of the rested hand of the player a cantilever plate is mounted on the upper part and acts as a lever, being oriented in Y-direction and parallel or nearly parallel to the top surface of the playing board. The cantilever plate can be moved and depressed by the player's carpus. The swinging movability of the cantilever plate is oriented in Z-direction. The bearing and mounting components, which are placed inside the playing board, are arranged and constructed in such a manner that a continuous and smooth movability of the control handle is rendered possible, preferably in Z and X-directions. For convenient movability of the control handle all its materials will be comparatively light, so as to have little inertia. The movements are comparatively short so that the special keys on the playing board might always be touched or struck easily by the fingers of the hand which is rested on the upper part.

Regarding the movability in the Z-direction, the control handle is automatically held at a neutral Z-position by means of one or more springs. Under the load of the player's hand the control handle will be moved downwardly in Z-direction against a stop device, arriving there at the normal Z-position. The path from neutral Z-position to normal Z-position, which will be further called $S_z$ serves for the control of continuous or gradual sound parameters by means of suitable mechanical-electrical converters. It is preferred that the volume of tones or sounds which had been selected by the main keys will be controlled that way.

At neutral Z-position the volume will be zero and during the down-motion it increases continuously up to that normal level which has been pre-adjusted by means of usual control members. The stop devices for the normal Z-position have one or more mechanical-electrical converters which preferably convert the bearing pressure of the player's hand, laid on the control handle, into electrical control signals. At little pressure the normal level will be dialed, whereas the normal level will be boosted continuously up to the maximum level if the bearing pressure will be increased.

By means of these two modes of control the envelope curve of tones or sounds can be controlled at any time just as desired, thus rendering possible a shaping of the attack and execution of sounds which is as subtle as it is possible when playing a conventional wind instrument for example. The described pressure control renders possible a very quick and easy playing of accents of tones or sounds.

An additional circuitry deriving from the present invention is given through the fact that a noise-gate can be switched on at the neutral Z-position.

Regarding its movability in X-direction, the control handle takes its neutral X-position at ± X. This position might be found and held automatically by springs. Starting from this neutral X-position, the control handle can be driven in +X as well as in −X direction until it will be stopped by stop devices. The whole path from +X to −X, which will further be called $X_x$ serves to control continuous or gradual sound parameters by means of fitting mechanical-electrical converters. It is preferred that the variation of the pitch of the tones or sounds which had been selected by the main keys will be controlled that way. If the control handle is at neutral X-position the pitch will not be altered. Moving the control handle in −X direction, the pitch will become lower; in +X direction it will become higher.

It follows from the present invention that a circuitry for the editing of the control signals provides two modes of control which might be dialed and selected by special keys, for cooperation. The first mode of control is related to the variation of pitch which can be continuous or gradual or stepped, just as one chooses. If the variation is gradual the degrees of the tempered tone system will be applied. The second mode of control is working in such a manner that, moving along $S_x$ the pitch will be altered in different ranges, just as one chooses. One mode of action provides a variation of ± two semi-tones at maximum, whereas a second mode of action provides a maximal control range of ± one octave.

By means of such modes of control related to the X-movability it is possible to alter the pitch of tones or sounds at any time just as desired, thus rendering possible a subtle control of the pitch similar to that which one can play on a conventional stringed instrument, such as a violin, for instance. With the stepped control it is possible to play slurs of tones or of chords like on guitar, for instance.

If the two free ends of the upper part, which further will be called rests, are contacted and stressed by the weight of the player's hand, mechanical-electrical converters will convert different pressures on these rests into electrical sound signals which serve for continuous or gradual control of sound parameters. It is preferred that the timbre of tones or sounds which had been selected by the main keys will be controlled that way.

If both rests will be loaded equally an average timbre is dialed. If the −X rest is loaded more than the +X rest, then the timbre will preferably be altered to a dark/soft character and otherwise, if the +X rest is loaded, then the timbre will preferably be altered to a bright/hard character.

By means of this mode of control it is possible to control the timbre of tones or sounds in a subtle and easy way. Regarding the variability of timbre, the acoustical charm and animation of conventional wind instruments will be achieved, for example.

The above mentioned cantilever plate, mounted on the upper part of the control handle to be contacted and depressed by the player's carpus, serves for continuous or gradual control of further sound parameters by means of fitting mechanical-electrical converters. It is preferred that the volume and/or the timbre of noises, which had been generated by the main or special keys, will be controlled that way.

Unburdened, the cantilever plate will be maintained in its upper neutral position. At this neutral position, the volume of a wind noise, for example, might be zero. If the load onto the cantilever plate will be increased continuously, the volume of wind noise can be altered continuously up to a maximum level. Corresponding to the volume, or otherwise independently of it, the timbre of a noise can be controlled from a dark/soft to a bright/hard character.

By means of this mode of control it is possible to alter the volume and/or timbre of noises at any time just as desired, allowing an easy playing technique.

Noises occurring within the phase of the attack of tones such as striking or plucking noises, wind or bow noises of conventional plucked, stringed or wind instruments, but also noises having the character of consonants of the human speech can be controlled thus rendering possible an extended and improved technique for the shaping of sounds.

Using certain special keys, the above mentioned modes of control can be switched on or off, just as desired. It is obvious that these modes of control might also be used for the control of other, additional sound parameters.

The other special keys, which are also placed on the playing board, preferably serve the following modes of control: An array of special keys serves for the repetition or the first stroke of tones and/or sounds which had been dialed on the main keys, that means, these special keys serve for the first or for the repeated attack, dynamic, and damping of the mentioned tones and/or sounds. By means of a circuitry, following the present invention, tone degrees which had been dialed on the main keys can be connected to the special keys in some different consecutive sequences, individually or accumulated in chords. This mode of control serves for an improved and extended playing technique with regard to the performance of the rhythmical structure of single tone-, chord- or other sequences. It is well known that the damping of tones and sounds will be started at that moment when the main or special keys which had been struck are released or let off. It follows from the invention that different modes of damping can be used if other special keys will be touched or released.

A first damping mode is given through the fact that, after letting loose, the envelope curve of a played tone or sound decreases at such a rate down to zero that a certain resonance or reverberation is executed thus providing a normal legato style. This mode of control will be called normal damping.

A second damping mode is given through the fact that, after letting loose, the envelope curve of a played tone or sound decreases abruptly down to zero, thus providing a staccato style. This mode of control will be called short damping.

A third damping mode is given through the fact that, after letting loose, a played tone or sound will be continued unaffectedly until that moment when one or more following keys will be struck. The attack signals of these following tones or sounds switch the damping control signal of the prior tone or sound immediately or almost at once. The damping control signal starts a quick descent of the envelope curve of the prior tone or sound down to zero. This damping mode produces a perfect portamento style. This mode of control will be called short hold.

A fourth damping mode is given through the fact that, after letting loose, the played tones or sounds will be continued unaffectedly until a damping with a suitable envelope curve will be switched on through the use of a special key. This mode of control will be called constant-hold. This mode corresponds substantially to the use of the pedal of a piano.

These mentioned damping modes can easily be switched on or off at any time by special keys, which are preferably placed in the action range of the player's thumb. Additional special keys are placed on the playing board to control the attack, dynamic and damping of noises, that means, that by using these special keys, noises can be played in connection or without any connection to tones dialed on the main keys. Using this mode of control, percussive rhythmical noise elements can easily be added to tone sequences, for example.

The typical sound patterns of conventional acoustic musical instruments are physically mainly characterized through their frequency spectrum and the envelopes of their sound components. The rate of noise components can play an important and completing role in tone instruments. These typical sound patterns, for instance that of a violin, a flute or a piano, will be called a sound type.

Additional special keys are placed on the playing board, serving for a quick dial of various sound types. If such a special key will be played, the corresponding sound type will be switched on, whereas the former sound type will be switched off. It follows from the present invention that the addresses of different sound types, being switched on by common control members, which are placed on the playing board in a remote array, can be connected to said spacial keys in any allocation, just as the player needs it.

An advantage of such mode of control is that a very fast access to different sound types is rendered possible, sound types which had been selected before the beginning of the performance. For a simplification of the playing technique of double stops or two-tone-fingerings on the main keys, several additional special keys are placed on the playing board to control an automatic addition of a second tone degree, which will be related with a certain delay to the first tone degree being played on the main keys. Preferably the interval provides a second tone degree below the first one. The special keys only control the dial of the additional tone degree, the attack and dynamic of it will be controlled by the main keys. If such a special key will be released, the second tone degree will be damped immediately. Distinct intervals will be allocated to distinct special keys.

Using this mode of control a very fast performance of double tone sequences can be played very easily.

Playing on another special key, a circuitry can be switched on with which the interval structure of any chord will be analyzed and memorized for automatic addition to all tone degrees of the structure to any further single tone played on the main keys. Those circuitries are known and have been applied in synthesizers. If the mentioned special keys will be released, the memorized interval structure will be cleared.

Another special key is provided on the playing board with which a recording device can be switched on to record all sound events or control signals which are played on the instrument of the invention at the same time when the special key is touched. The releasing of this special key finishes the recording. By touching one or more other special keys, the recorded sequences can be started for playback, always beginning with the first sound event or control signal and repeating the playback one or more times, just as the player desires. Another special key serves for the interruption or termination of the playback. Renewed touching of the special key for recording clears all former recordings. The electronic devices for such recording and playback equipment are known as so-called sequencers for live edition. By means of this mode of control repeating sequences of tones or sounds can be played very easily without any interruption of the flow of the other playing actions.

It is self-evident that further special keys can be placed within the action range of the player's fingers for the control of additional sound parameters and/or playing functions. They will be described later with reference to a preferred embodiment.

A turning knob is mounted on the playing board within the action range of the player's thumb, the axis of rotation of which is oriented in Z-direction. Thus turning knob can be turned and slid around or along this axis in combination. By turning it, the master volume can be controlled continuously from zero to the maximum, by sliding it, the reverberation can be controlled continuously from zero to the maximum, for example.

The advantages of the present invention include the fact that the described additional control device renders possible an easy clearly arranged and sensible control of large numbers of most important sound parameters, and these sound parameters can be controlled simultaneously without influencing each other under a continuous or gradual mode of control. Furthermore playing functions are provided which simplify the playing technique and expand the playing capabilities. Thus, tones and sounds played on the main keys can be shaped and embellished to an extent which has to be required for a superb and subtle live performance. The full utilization of advanced electronic equipment for sound generation and sound shaping has become possible, and an instrument according to the invention offers the practicability of the characteristic control modes of nearly all conventional musical instruments. All described features give the instrument the capacity of an universal instrument.

DESCRIPTION OF THE PREFERRED EMBODIMENTS

Figure 1:
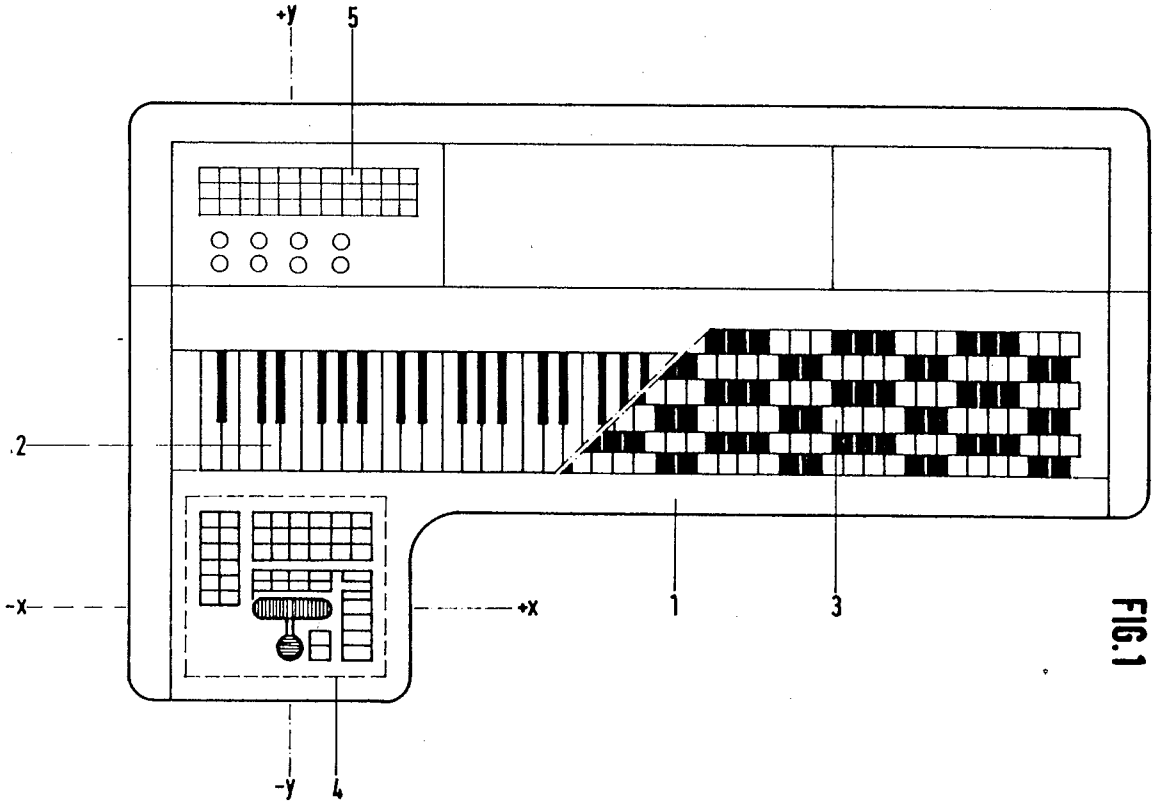
FIG. 1 is a top plan view of a playing board according to a preferred embodiment of the invention, parts being shown somewhat schematically or diagrammatically.
Figure 2:
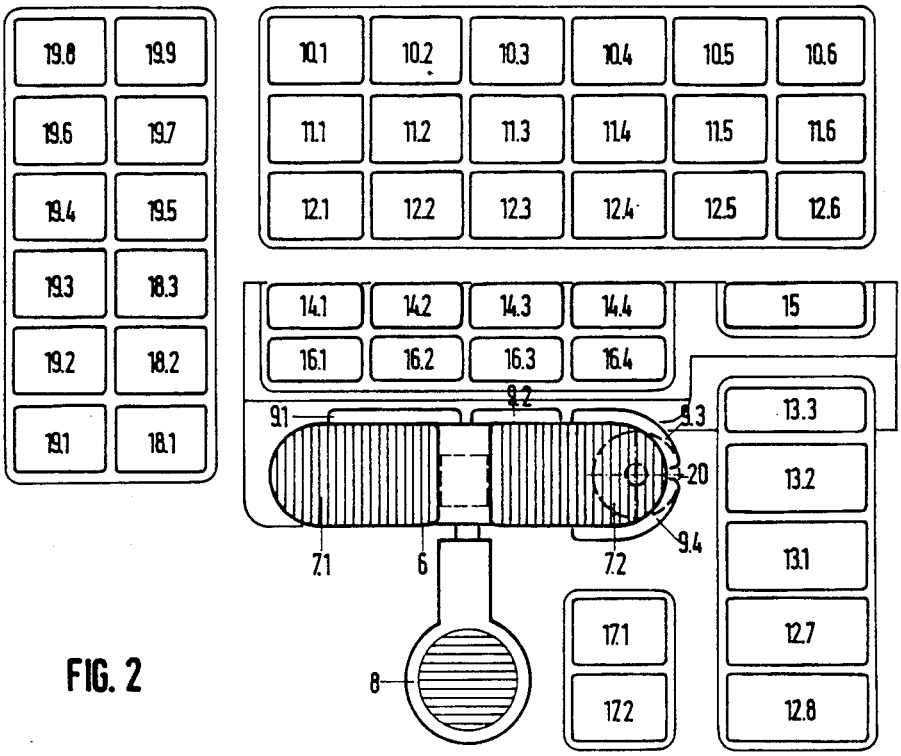
FIG. 2 is a top plan view of the control device, arranged for a left hand playing, forming part of FIG. 1, but on a much larger scale.
Figure 3:
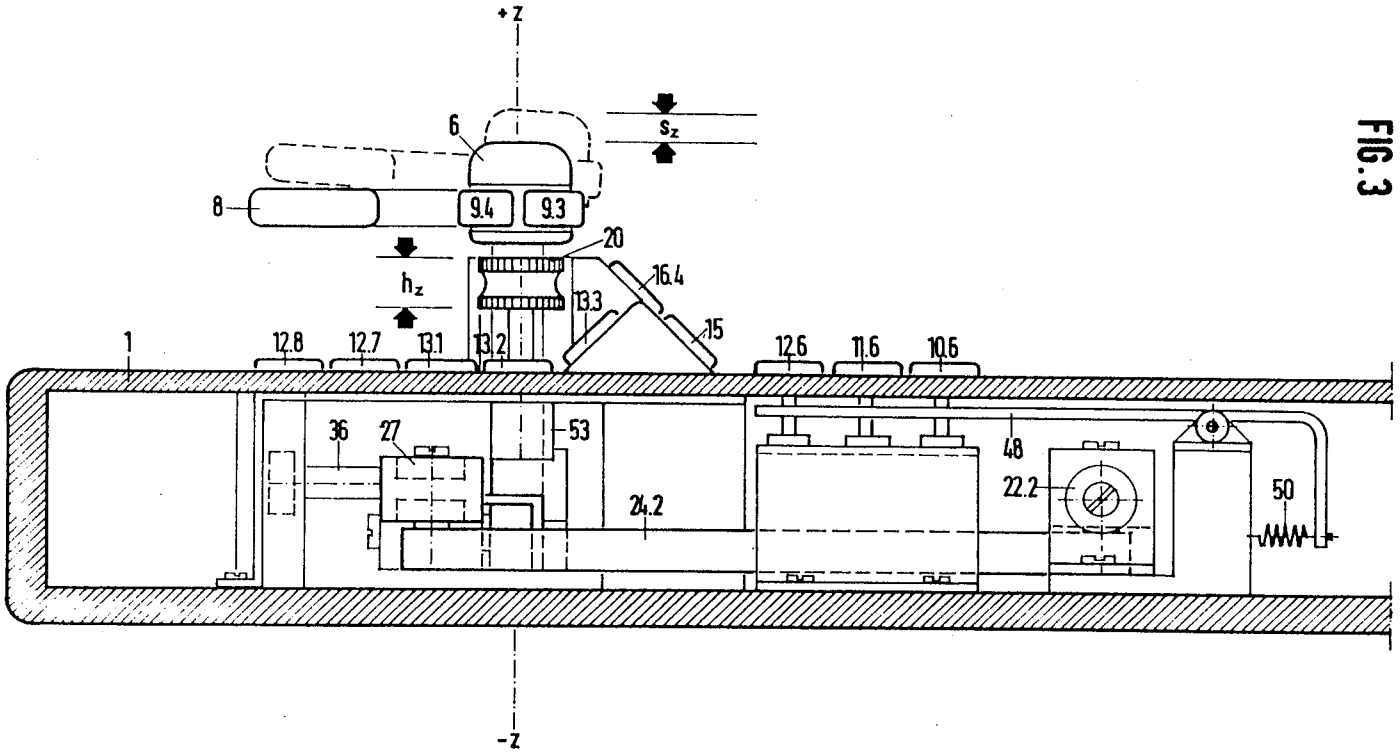
FIG. 3 is a vertical section of the playing board in Y-direction with parts of the additional control device shown in FIG. 2 in elevational view.
Figure 4:
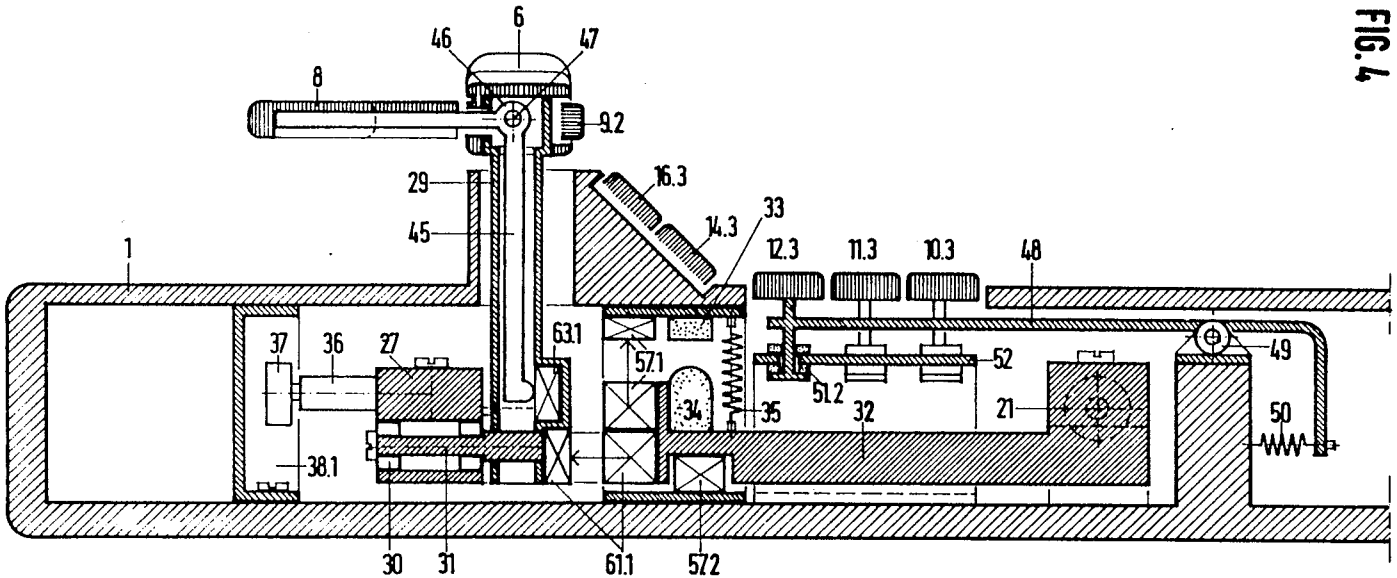
FIG. 4 is a vertical section of the playing board and of the additional control device shown in FIG. 2, in Y-direction.
Figure 5:
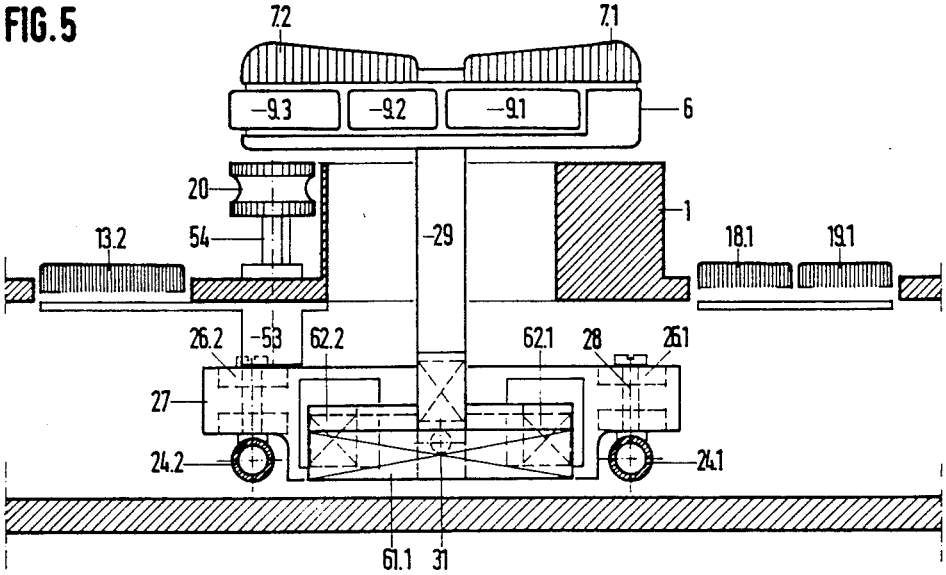
FIG. 5 is a vertical section of the playing board and of the additional control device shown in FIG. 2, in X-direction.
Figure 6:
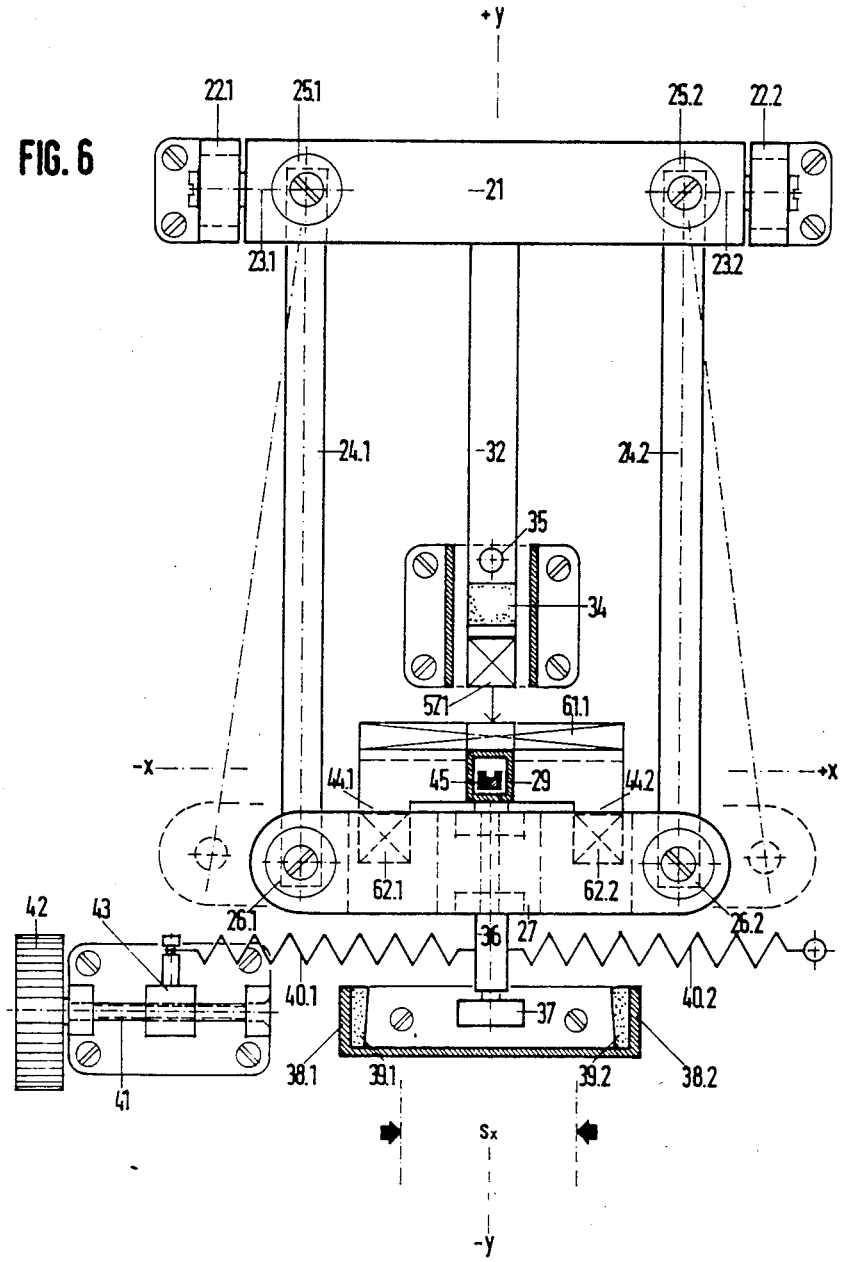
FIG. 6 is a top plan view of the parts of the control device shown in FIG. 2–5, being located inside the playing board.

FIG. 1 shows the playing board 1 with the main keys, being embodied as a conventional keysystem 2, with upper and lower keys, or instead of that, being embodied as a key system 3 following the German patent application 34 34 160.9. Furthermore, the control device 4 of the invention is shown here. The usual control and regulation means 5, which will be hardly used during a performance are shown somewhat schematically on a part of the playing board 1, which will be called a desk. The main keys 2 or 3 are mounted on the playing board 1 at such a level that, in relation to the additional control device 4, any restriction by overlapping parts will be avoided when a two-handed playing on the main keys is executed. FIG. 2, supplemented by FIGS. 3 and 5, shows the parts of the additional control device 4 which are placed on or above the top surface of the playing board 1 for playing. The upper part 6 of the control handle, being shaped like a grip, has two rests 7.1 and 7.2 to be contacted and guided by the player's palm, furthermore, a special key 9.1, preferred to switch a continuous variability of the pitch, a special key 9.2, preferred to switch a gradual or stepped variability of pitch; a special key 9.3, preferred to switch the first voice of chords; and a special key 9.4, preferred for an altering switch of different ranges of the variability of pitch.

The allocation of various control functions to certain special keys, described as follows, is only one preferred embodiment. All other possible allocations will not be described, even though they belong to the objects of the invention.

Special keys 10.1–10.6 serve for the switching on of tone—or noise—types, being connected to the special keys 10.1–10.6 through the control and regulation means 5.

Special keys 11.1–11.6 serve for the control of attack, of dynamic including the corresponding variation of timbre, and of the damping of noises.

Special keys 12.1–12.8 serve for the control of repetition, that means the control of a repeated or first attack, dynamic including the corresponding variation of timbre, and damping of tones or sounds which had been played or dialed on the main keys.

The special key 12.1 serves additionally for the switching on of the repetition in block chord mode.

The special key 12.2 serves additionally for the switching on of the repetition in single tone mode.

The special key 12.7 serves additionally for the switching on of the consecutive sequencing of single tones from bass to treble.

The special key 12.8 serves additionally for the switching on of the consecutive sequencing of single tones from treble down to bass.

A special key 13.1 serves for the switching on of the constant hold.

A special key 13.2 serves for the switching on of the short damping and a simultaneous switching off of the constant hold and short hold, when touching the special key 13.2.

A special key 13.3 serves for the switching on of the short hold.

Special keys 14.1–14.4 serve for the simplification of double-tone-fingerings, that means, a tone degree is automatically added in a certain interval relation to a tone played on the main keys just as the player selects it through one of the special keys 14.1–14.4.

A special key 15, being touched, serves for the switching on of circuitries for the analyzing and memorizing of any chord structure being played on the main keys; and for the automatic addition of tone degrees following the chord structure to any single tone subsequently played on the main keys; and for the clearance of all memorized data through the release of the special key 15.

Special keys 16.1–16.4 serve for the control of a simplified repetition of tone or sound sequences. A special key 16.1 serves for the switching on of a recording equipment, recording all control signals transmitted by the main keys 2 or 3 and by the control device at that time. If this special key 16.1 is released, the recording will be stopped. A new touch on the special key 16.1 switches the clearance of all former recording data.

A special key 16.2 initiates the start of a single playback of the recorded control signals.

A special key 16.3 initiates the start of a playback of the recorded control signals, running as often as desired.

A special key 16.4 starts the interruption of the mentioned playback.

A special key 17.1 switches on a circuitry which conducts all voices of a chord to a chorus circuitry with the exception of the first or highest voice.

A special key 17.2 switches on a chorus circuitry with which all voices will be affected.

Special keys 18.1–18.3 serve for the channel selection at stereophonic operation.

Special key 18.1 switches on the left channel.

Special key 18.2 switches on both channels.

Special key 18.3 switches on the right channel.

Special keys 19.1–19.8 initiate additional functions which will be described later on.

The special keys 10.1–10.6, 11.1–11.6 and 12.1–12.6, comparatively played very often, are arranged in X-direction, and the width of each of these special keys is preferably equal to that of a main key. They are located at such a distance from the upper part 6 that they can be played easily by the little finger, but mainly by the ring-, middle- and the forefinger of the hand resting on the upper part 6.

The special keys 14.1–14.4, 15. and 16.1–16.4 are preferably mounted on an inclined edge of the playing board 1 to achieve an ergonomic improvement of the playing. The special keys 9.1–9.3 mounted on the upper part 6 and will be played with the mentioned fingers, too.

The special keys 12.7 and 12.8, 13.1–13.3, 17.1 and 17.2 are arranged in Y-direction, and the width of a key in Y-direction is equal to the width of a main key. They are located at such a distance from the upper part 6 that they can easily be played with the thumb of the hand resting on the upper part 6.

The extended length of special keys 12.7 and 12.8, as well as 13.1–13.3 in X-direction serves to compensate for the thumb motions while the control handle is moved in X-direction.

The special keys 18.1–18.3 and 19.1–19.3, which are rather seldom played, are placed in an action range for a less comfortable playing by the little finger or even other fingers.

The turning knob 20, placed on the playing board 1 within the action range of thumb, serves preferably for the continuous control of the master volume from zero to maximum and additionally for the continuous control of the electronic reverberation from zero to maximum.

FIGS. 3, 4, 5 and 6 show the mechanical construction of the control handle and the construction of some special keys. The bearing and supporting parts of the control handle are placed inside the playing board and are preferably designed as a parallelogram guiding mechanism. This mechanism consists of a prime supporting piece 21, which is mounted on the playing board 1 by means of pivot bearings 22.1 and 22.2. The rotational axes 23.1 and 23.2 of the pivot bearings 22.1 and 22.2 are oriented in X-direction. The prime supporting piece 21 is connected with a secondary supporting piece 27 through bearing arms 24.1 and 24.2 including pivot bearings 25.1, 25.2, 26.1 and 26.2. The axes of rotation of the pivot bearings are oriented in Z-direction.

The upper part 6 is mounted on a secondary supporting piece 27 by means of a hollow pillar 29 including a pivot bearing 30. The rotational axis 31 of the pivot bearing 30 is oriented in Y-direction.

The pivot bearings 22.1 and 22.2 allow the control handle to be moved in Z-direction. A stop-arm 32 limits this movability. Upwards in +Z-direction it strikes against a stop-block 33 mounted on the playing board. To avoid ambient noises, this stop-block 33 and/or a buffer block 34 mounted the stop arm, are made of sound absorbing material. Moved down in Z-direction the stop-arm 32 strikes preferably against a mechanical-electric converter 57.2 as a lower stop-device. This converter 57.2, which is mounted on the playing board 1, converts preferably all mechanical pressures of the stop-arm 32 into corresponding electric control signals. The actual spatial position of the stop arm 32 can be converted into corresponding electric control signals through the mechanical-electrical converter 57.1. The upper position is defined as the neutral Z-position, the lower as the normal Z-position. The path $S_z$between these two positions provides the maximal regulation passage concerning the Z-movability. A tension spring 35 automatically holds the control handle in the neutral Z-position. The parallelogram guiding mechanism allows the control handle to be moved in X-direction. A stop peg 36, striking with its stop-roll 37 against stop-flanges 38.1 and 38.2, limits that movability. Two muffling buffers 39.1 and 39.2 are provided to avoid ambient noises.

In the middle between the two stop positions the control handle will arrive at its neutral position. This neutral X-position can be achieved automatically through preloaded tension springs 40.1 and 40.2. For a perfect adjustment, the seat of one of the two tension springs 40.2 can be adjusted by means of a threaded spindle 41, an adjusting wheel 42 and a bearing block 43. The mechanical-electrical converter 61.1 converts the actual position of the control handle into corresponding control signals. The path $S_x$ between the two stop positions provides the maximal regulation passage concerning the X-movability.

The pivot bearing 30 allows a movability or rotation of the upper part 6 in Z-direction, including its two rests 7.1 and 7.2. A real rotation is avoided through the fact that flanges 44.1 and 44.2 which are fixed rigidly to the hollow pillar 29, are pushing against the mechanical-electrical converters 62.1 and 62.2, the latter being mounted on the secondary supporting piece 27. If the rests 7.1 or 7.2 unequally stressed by the player's hand, the pressure on the converters 62.1 and/or 62.2 changes analogously. These various pressures will be converted into corresponding electrical control signals.

The cantilever plate 8 is movably connected with the upper part 6 through a hoop 45 and a turning bearing 46. The axis 47 of rotation of the turning bearing 46 is oriented in X-direction. A tilting of the cantilever plate 8 is avoided through the fact that the hoop 45 pushes against a mechanical electrical converter 63.1 with its free end. This converter 63.1 converts the various pressures of the hoop 45 into corresponding electrical control signals. The rests 7.1 and 7.2 are inclined toward the middle of the upper part 6 and are corrugated. Both features serve to enhance the power transmission of the player's hand, particularly with regard to movability in X-direction.

The above mentioned converters are known. To avoid mechanical attrition or abrasion, converters which have an opto-electronic mode of operation for conversion of spatial positions are preferred. Converters which use electrical or magnetical fields for the measurement can be used too.

Special keys, such as 11.1–11.6 and 12.1–12.8, which also serve to produce dynamic control signals are not designed as simple switches as the other special keys are, but they are preferably fixed on a key lever 48, which is mounted on the playing board 1 by means of turning bearings 49. A tension spring 50 holds the key lever 48 in its neutral position. Lower stop buffers 51.1 and upper stop buffers 51.2 mounted on a trestle plate 52 define or limit the lift of the key lever 48. The aforementioned switches and dynamic converters of the special keys can be put to use in a manner known to those skilled in the art.

The turning knob 20 has a rotation and sliding axle 54, which is oriented in Z-direction, enabling the turning knob 20 to be turned and slid at the same time, thus controlling two control signals or sound signals independently of each other. Such regulating means are known.

The control handle which has not been identified by a character, is understood as the whole unit, put together by all the component parts which have been described so far.

FIGS. 7, 8, 9, 10, 11 and 12 show the essential attributes of the electronic functions of the control device 4. Just as already mentioned, the additional control device 4 can be designed to produce or influence control signals as well as sound signals. Because of greater flexibility and compatibility concerning the connection with different equipment for sound generation and sound shaping, the description of an embodiment for a mode of work mainly with control signals is preferred.

Figure 7:
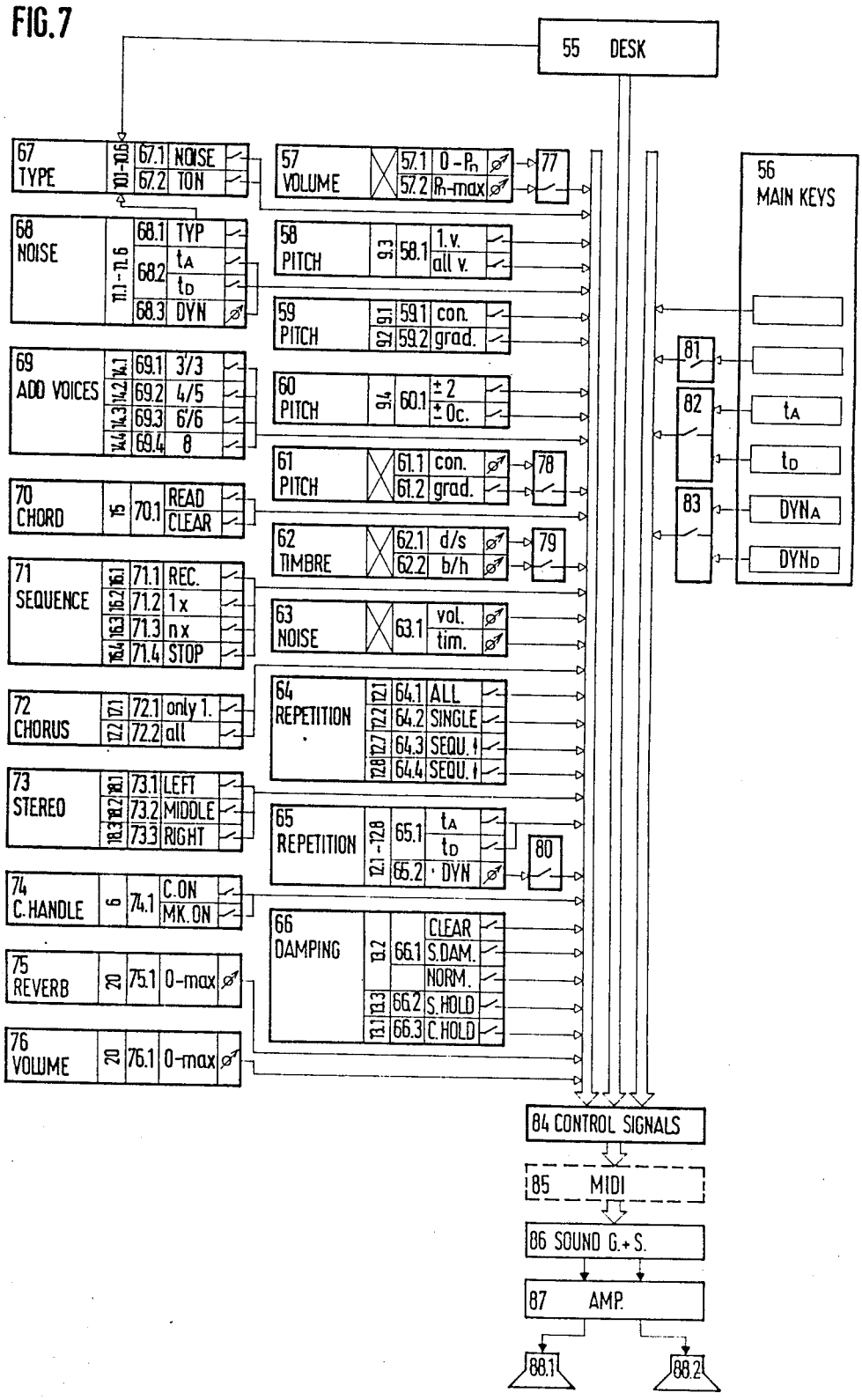
FIG. 7 is a block diagram of the main control functions of the control device in connection with the main keys and an equipment for the generation and shaping of sound.

FIG. 7 shows a scheme of the essential control functions of a musical instrument which is equipped with the control device 4. Control signals will be produced or influenced through usual control and regulation means 5, here symbolized by block 55 "Desk"; furthermore, by the main key system 2 or 3, here symbolized by block 56 "Main keys", and the blocks 57 - 83, representing functions of the control device 4. These control signals will be prepared in a circuitry block 84 "Control signals", preferably in digital form. An interface block 85, standardized like the interface standard MIDI for instance, prepares the format and the transmission of the control signals in such a way that even equipments for sound generation and shaping made by different manufacturers can be controlled, provided they are enabled to receive these MIDI-data. The sound signals of the equipment for sound generation and shaping, block 86 "Sound G. +S." are transmitted via the power amplifier block 87 "Amp." to the loudspeakers 88.1 and 88.2. The mode of operation of the blocks 57–83 will be symbolized by an Ø, if a continuous control is given, and by an _/_, if a discrete or stepped control takes place. The of the mechanical control means being actually concerned are shown within the blocks for better understanding, and the ciphers are turned at a 90°-angle.

In the present example the main keys block 56 produces the following sound parameters: The actually dialed tone degree, eventually added noise components, the moment of the attack of sound "$t_A$", the beginning of damping of the sound "$t_D$", the dynamic "$Dyn_A$" and possibly the dynamic of the releasing or damping dynamic "$Dyn_D$".

The mentioned noise components can be added or switched off through the special keys 19.6 and 19.7, including block 81. The attack and/or the damping of sound can be switched on or off through the special keys 19.4 and 19.5, including block 82. If they are switched off, attack and damping of tones or sounds which have been dialed on the main keys 2 or 3, are only controllable through the special key 12.1–12.8.

The dynamic and possibly the dynamic of damping can be switched on or off through the special keys 19.8 and 19.9, including block 83. When switched off, a fixed amplitude will only be executed, thus rendering possible an easy performance of a harpsichord or an organ.

The blocks 57–83 show various control functions of the control handle and the special keys.

Block 57 shows the function "Volume", here the output of control signals for the control of the volume of tones or sounds which had been played on the main keys, block 56. The control is executed by means of the converter 57.1 from zero up to the normal level "O-$P_n$", and by the converter 57.2 from the normal level up to the maximum level "$P_n$-max."

The control functions of block 57 can be switched on or off through the special key 19.3, including block 77.

Block 58 shows the function "Pitch", here the alternating switch of a separated control of the first voice or alternatively the control of all voices by means of the switch 58.1 or the special key 9.3. If the control function "1.V" is switched on, only the highest or first voice of a chord, being placed on the main keys block 56, is fully controllable, all other voices cannot be controlled through blocks 57, 61 and 62 any more. This function renders possible continuous variation of the pitch of the first voice of chord, for example, without any influence on the others. If the control function "all V." is switched on, all voices are controlled without any restriction. Block 59 shows the function "Pitch" here the switch of a continuous pitch variation through the switch 59.1 of the special key 9.1, or alternately a gradual or stepped pitch variation through the switch 59.2 of the special key 9.2. If the control function "Con" is switched on, the pitch of all tones will be altered continuously under the X-motion of the control handle. If the control function "Grad" is switched on, the pitch of all tones will be altered gradually in response to the X-motion of the control handle; a stepwise alteration according to the degrees of the tempered tone system is preferred.

Block 60 shows the function "Pitch", here the alternating switch of two different ranges of the pitch variation through the switch 60.1 of the special key 9.4. If the control function "± 2" is switched on, the pitch can be altered to a maximum of ± two semitones under the full passage of $S_x$. If the control function "$\pm O_c$" is switched on, the pitch can be altered to a maximum of ± one octave under that same passage of $S_x$.

Block 61 shows the function "Pitch", here the output of control signals for a continuous or gradual pitch variation of tones being played on the main keys block 56. This is executed by the converters 61.1 or 61.2. If a continuous pitch variation has been switched on through block 59, the pitch will be altered continuously along the regulation passage $S_x$. If a gradual pitch variation has been switched on through block 59, the pitch will be altered gradually along the regulation passage $S_x$ even though it is preferred that equal linear steps correspond to equal tone degrees.

Figure 12:
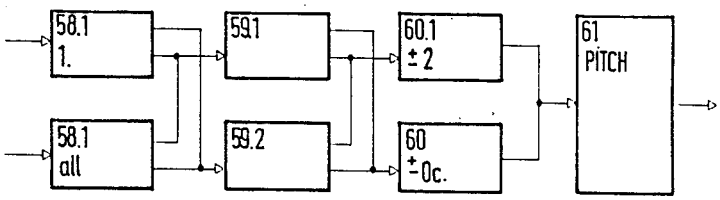
FIG. 12 is a block diagram of the main control functions with special relation to the control of pitch of tones.

For a better comprehensibility FIG. 12 shows one more of the above-mentioned functions "Pitch" as they are connected in a network.

By means of the special key 19.1 and the switch of block 78, the function of block 61 can be switched on or off.

Block 62 shows the function "Timbre", here the output of control signals for a continuous or gradual variation of the timbre of tones or sounds played on the main keys block 56. This is executed through the converters 62.1 and 62.2. The application of pressure to the two converters 62.1 and 62.2, being related to each other, results in the generation of control signals which provide the normal timbre, if these converters are equally loaded and which change the timbre continuously towards dark/soft if the converter 62.1 is more loaded, and which furthermore change the timbre continuously towards bright/hard if the converter 62.2 is more loaded reversely.

By means of the special key 19.2 and the switch of block 79, the functions of block 62 can be switched on or off.

Block 63 shows the function "Noise", here the output of control signals for the continuous or gradual variation of the timbre of noises, played on the main key block 56 and/or the special keys block 68. This is done by the converter 63.1. If the converter 63.1 is unstressed, the normal volume level and normal timbre are provided, for example. If the stressing increases, the volume will be boosted continuously and the timbre can be continuously altered to bright/hard.

Block 64 shows the function "Repetition", here the activation of the control function "All" through the switch 64.1; the activation of the control function "Single" through the switch 64.2; the activation of the control function "Sequ. ↑" through the switch 64.3; and the activation of the control function "Sequ. ↓" through the switch 64.4.

Figure 8:
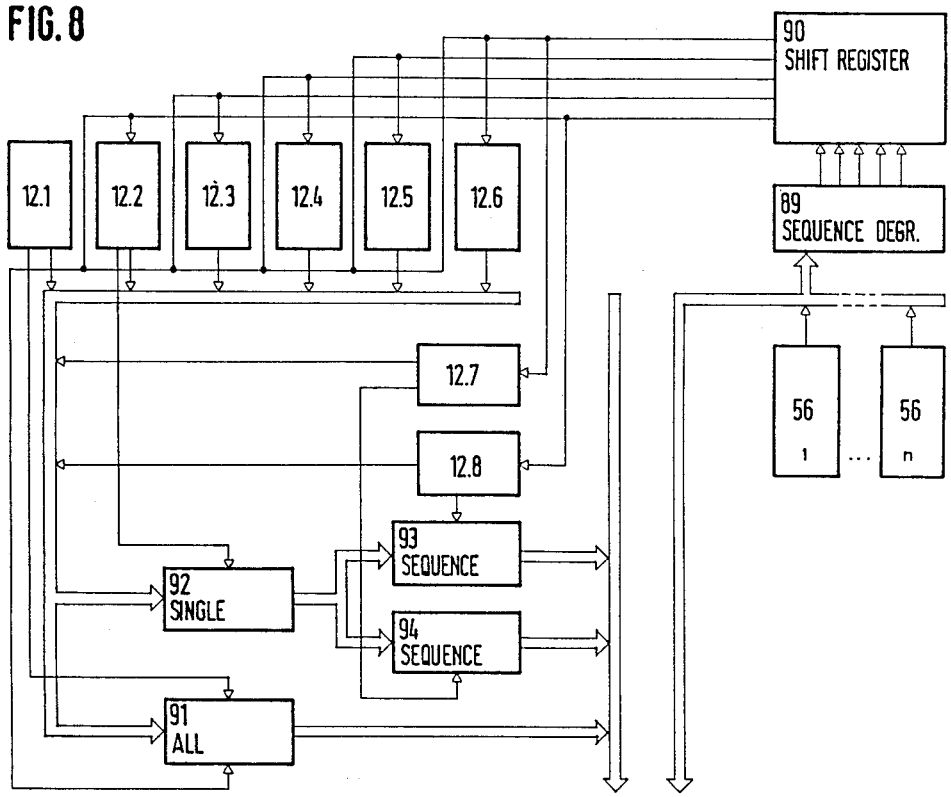
FIG. 8 is a block diagram of the main control functions with special relation to the control of the repetition of tones or sounds.

FIG. 8 more clearly shows the working mode of these functions: If one or more tone degrees are dialed on the main keys block 56, then their addresses will be transmitted to the circuitry of block "Sequence degr. ", by means of which the requested mode of connection of the special keys 12.1–12.8 with the tone degrees will be provided. The addresses of the dialed tone degrees will be held in the circuitry of block 90 "Shift register", even if the main keys of the block 56 are released, just as long as one or more new tone degrees will be dialed on the main keys of block 56, and these new tone degrees are shifted into the position of the former degrees.

Playing the special key 12.1 with the switch 64.1 the circuitry block 91 "All" will be activated, and all tone degrees, which are synchronously dialed or played on the main keys block 56, can be repeated in a chord mode through the special keys 12.1–12.8.

Playing the special key 12.2 with the switch 64.2 the circuitry block 92 "Single" will be activated, and all tone degrees which are synchronously dialed or played on the main keys block 56, can be repeated in a single line sequence through the special keys 12.1–12.8.

It is preferred that a maximum number of five synchronously dialed tone degrees are to be distributed one by one to the special keys 12.2–12.8. Through the special key 12.7 and the switch 64.3 the circuitry block 94 "Sequ. ↑" can be activated and all dialed tone degrees will be connected one by one to the special keys 12.2–12.7, arranged in sequence from bass to treble. Through the special key 12.8 and the switch 64.4 the circuitry block 93 "Sequ. ↓" can be activated and the connection to the special keys 12.2–12.6 and 12.8 will be executed reversely.

If less than five tone degrees have been dialed synchronously on the main keys block 56, the modes of connection, which will be executed then, are preferably as follows: for simplification of the description, only the sequence from bass to treble will be mentioned because the sequence from treble to bass is the same, but only reversed.

If four tone degrees have been dialed on the main keys block 56, the connection to the special keys is ordered in this sequence: 12.2, 12.3, 12.4, 12.5. 12.7 is attached to the highest tone degree, just as 12.5 is.

If three tone degrees have been dialed on the main keys block 56, the connection to the special keys is ordered in this sequence: 12.2, 12.3, 12.4. 12.7 is attached to the highest tone degree, just as 12.4 is.

If two tone degrees have been dialed on the main keys block 56, the connection to the special keys is ordered in this sequence: 12.2 and 12.4 are attached to the lower; 12.5 and 12.7 to the upper tone degree.

If only one tone degree has been dialed on the main keys block 56, the connection to the special keys is ordered in such a way that all special keys 12.2–12.7 are attached to the tone degree.

Block 65 shows the function "Repetition" here the control functions "$t_A$" meaning the moment of attack of the sound, and "$t_D$" meaning the beginning of the damping, both controlled by the switch 65.1. Furthermore, the function "Dyn" is shown with which a continuous control of the dynamics or volume of the sound can get controlled through the converter 65.2. All special keys 12.1–12.8 are designed to perform such functions. Converters for the control of the dynamics or volume are known in various types.

Through the special keys 19.8 and 19.9, including the switch of block 80, the control function 65.2 can be switched on or off. Block 66 shows the function "Damping", here the control function "Norm.", the normal damping, which is switched on by the switches 66.1–66.3, if all special keys 13.1–13.3 are let loose. Furthermore, it shows the control function "Clear", that is the clearance of any operating constant hold; and it shows the control function "S. Damp.", the short damping, both functions being switched through the special key 13.2, including the switch 66.1.

Block 66 shows the control function "S. Hold", the short hold, which can be switched on or off through the special key 13.3, including switch 66.2. As described above, the short hold is control function for the damping whereas tones or sounds, which had been played on the main keys block 56 or the special keys 12.1–12.8 for the repetition, will be continued until the new, following key will be struck, even though the first keys have been released after the attack. Electronically this is done in such a way that the control function "$t_D$" of all keys will be interrupted and additionally a circuit of block 95 will force the circuit of block 90 to retain the control signals of "$t_D$" until the control function "$t_A$" of the succeeding tone or sound will switch and start the "$t_D$" signals of the preceding tone or sound.

Figure 9:
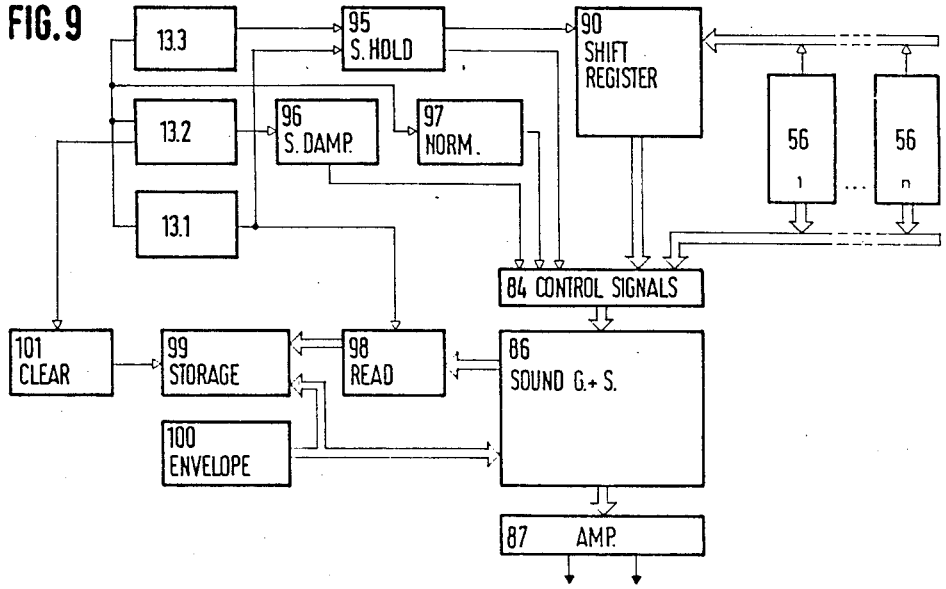
FIG. 9 is a block diagram of the main control functions with special relation to the control of the damping of tones or sounds.

Furthermore, the block 66 shows the control function "C. Hold", that is the activation of the constant hold through the special key 13.1, including switch 66.3. FIG. 9 more clearly shows this mode of operation: the special key 13.3 switches the short hold through block 95 "S. Hold". The circuit of block 95 provides a full restraint of the control function "$t_D$" and renders possible the control function "$t_D$" of the preceding tone to be started by the "$t_A$" signals of the succeeding sound event. The special key 13.2 switches the normal damping block 97 "Norm", the short hold block 96 "S. Hold", and the clearance of the constant hold block 101 "Clear" in the already mentioned way.

The special key 13.1 activates the constant hold, which is working in a preferred example as follows. The sound signals of tones or sounds of block 86 will be read out through the reading block 98 "Read" and will be conducted to a storage block 99 to be read out from here permanently under an envelope produced and controlled in block 100 and mixed with the original sounds of block 86 "Sound G. + S.". The clearance of the storage fill of block 99 will be executed through the special key 13.2; as has already been described, circuitry for such a constant hold is known and is applied in so-called reverberation devices. Block 67 shows the function "Type", here the switching on of various tone-types and noise-types through the switches 67.1 and 67.2 of the special keys 10.1–10.6 and in combination with that of the special keys 11.1–11.6. It follows from the invention that the addresses of distinct tone- or noise types, controlled by the control means of the desk 55, can be connected to the special keys 10.1–10.6 in an order just as desired, to be easily obtained at any time. If only the special keys 10.1–13.6 are played, the actual tone type will be switched on. If a special key 11.1–11.6 including switch 68.1 is additionally played, then distinct tone types can be obtained through the special keys 10.1–10.6.

Figure 10:
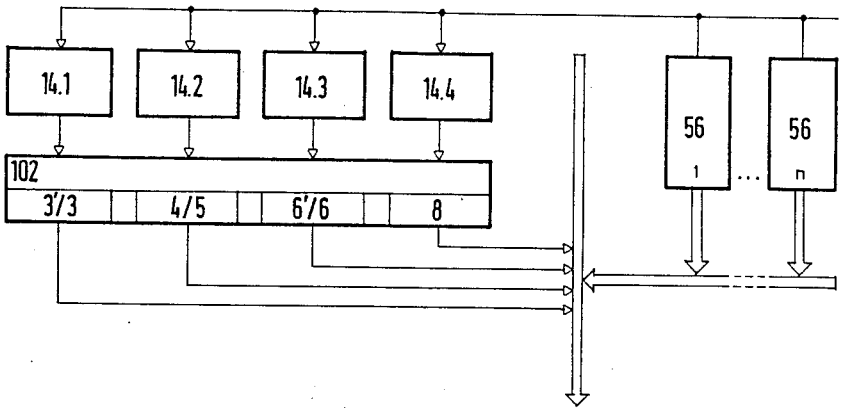
FIG. 10 is a block diagram of the main control functions with special relation to the control of two-voice-chords.

Block 68 shows the function "Noise", here the control function "Type" with which distinct noise types can be obtained through the switch 68.1, just as mentioned before. Furthermore, block 68 shows the control function "$t_A$", that is the attack, and the control function "$t_D$" the beginning of the damping, both controlled through the switch 68.2; and the control function "Dyn" producing continuous control signals for the control of the volume or dynamics through the converter 68.3. All special keys 11.1–11.6 are equipped with said control functions. Block 69 shows the function "Added voices", here the automatic addition of a second tone degree to a tone degree which had been dialed on the main keys block 56 through the special keys 14.1–14.4. FIG. 10 illustrates this mode of control. If the special key 14.1 is touched, a circuitry block 10.2 will be activated then through the switch 69.1, adding automatically a minor third "3'" or a major third "3" under any tone being played on the main keys block 56. The control functions "$t_A$, $t_D$ and Dyn" of the main keys block 56 control the added tone degree too. Touching the special key 14.2 an added tone-degree of a fourth "4" or a fifth "5", and touching the special key 14.3 an added tone-degree of a minor sixth "6'" or a major sixth "6", and touching the special key 14.4 an added tone degree of an octave "8" will be executed. If the main key system 3 is applied, the minor intervals "3', 4 and 6'" can be connected to a main-key-double-row other than the major intervals "3, 5 and 6". Especially when playing on the main key system 3 double stops can be played in a very convenient manner.

Block 70 shows the function "Chrod", here the activation of a circuitry through the special key 15 including the switch 70.1, a circuitry which analyzes and memorizes the interval structure of a chord played on the main keys block 56, and adds automatically all tone degrees according to that memorized chord structure to any single which will thereafter be played on the main keys block 56. The memorized chord data will be cleared if the special key 15 is released.

Block 71 shows the function "Sequence", here the control of an electronic device which is known as a so-called sequencer, an equipment with which sound or control signals can be recorded and played back. Through the special key 16.3 including the switch 71.1 the function "Read" is activated, that means that all signals from the main keys 56 and/or from the control device 4 will be recorded, as long as this special key 16.1 is held. If the special key 16.2 including the switch 71.2 is played, the control function "1X", that is a single playback, will be executed. If the special key 16.3 including the switch 71.3 is played, the control function "nx", that is a playback repeated as often as desired, will be executed. If the special key 16.4 including the switch 71.4 is played, the control function "Stop", that is the interruption of the playback, will be executed. If the special key 16.1 is played anew, all memorized data will be cleared.

Block 72 shows the function "Chorus", here the activation of the control function "only 1" through the special key 17.1 including the switch 72.1, that is a circuitry which selects the first or highest voice of any chord to be conducted to a chorus-equipment only. Through the special key 17.2 including the switch 72.2 the control function "All" is switched on, that means that all voices of a played chord will be conducted to the chorus-equipment.

Figure 11:
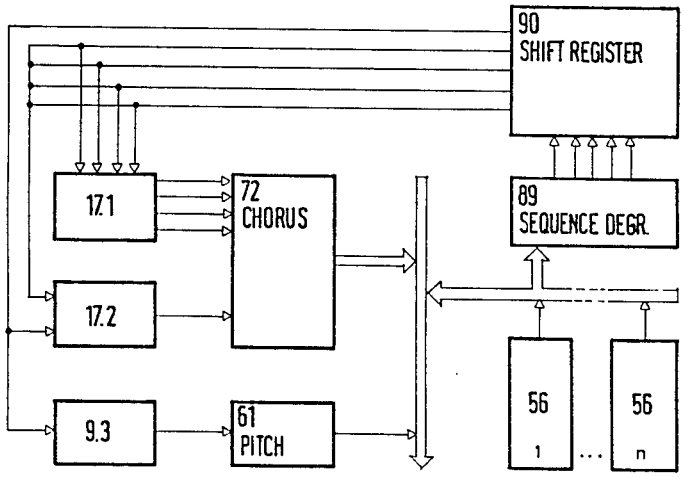
FIG. 11 is a block diagram of the main control functions with special relation to the control of the 1. voice of a chord.

FIG. 11 shows how the first voice of a chord played on the main keys 56 and selected through block 89 and 90, along a special path, is opened through the control function "All" with special key 17.2 and switch 72.2, whereas all other voices are directly conducted through the switch 72.1 to the chorus equipment block 72 "Chorus".

Furthermore, FIG. 11 shows how the first voice of a chord, selected through blocks 89 and 90 will be conducted to a special pitch control block 61 "Pitch" through the special key 9.3. This mode of control has already been described. Block 73 shows the function "Stereo", here the conducting of all played tones and sounds to a left channel through the special key 18.1 including the switch 73.1; to a right channel through the special key 18.3 including the switch 73.3; and balanced to both channels of a stereo equipment through the special key 18.2 including switch 73.2.

Block 74 shows the control function "C. handle", here the control function "C. on", that is the switching on of all functions of the control device 4 by means of switch 74.1, which is mounted within the upper part 6, and which preferably operates as a proximity switch. If the upper part 6 is touched or nearly touched by the player's hand, all functions will be switched on. If the hand is removed from the upper part 6 all functions will be switched off and a normal level of volume will be produced to render possible a normal playing on the main keys 2 or 3. This control mode allows an easy change of playing, either on the main keys 2 or 3 or on the control device 4.

Block 75 shows the function "Reverb.", here the continuous control of all components of an artificial reverberation through the turning knob 20 including the converter 75.1 at the control range from 0—max.

Block 76 shows the function "Volume", here the continuous control of the average level of volume through the turning knob 20 including the converter 76.1 at a control range from 0—max. It is obvious that some control functions or control modes the realization of which has been described as a hardware embodiment, can also be realized in a software embodiment. For the sake of shortness and clarity, a full description of all such modification has been dispensed with. However, these modifications belong to the invention too. The term circuitry which has been used in this description and in the claims embraces hardware and software.

What is claimed is:

1. A musical control apparatus for manually controlling the play of electronic musical keyboard instruments, each keyboard instrument having a group of main keys available for the control of tone degrees, the musical control apparatus comprising:

(a) a support;

(b) a control handle with a held and guided elongated part oriented in an x-direction, said control handle being mounted on said support for registering control actions by a player's hand resting on the control handle and said control handle being mounted for allowing movement executable independently and simultaneously in at least two additional directions including a z-direction at right angles to said x-direction and a y-direction at right angles to said x-direction and said z-direction;

(c) converter means connected with said control handle for converting said hand movements into corresponding first electrical signals and additional converter means connected with said control handle for converting different loads of a player's hand on said control handle into corresponding second electrical signals, all of said first and second electrical signals controlling in a continuous or stepwise simultaneous manner at least one of the volume, pitch and timbre characteristics of an output sound;

(d) a plurality of special keys with electrical switching or conversion means for the controlling of complete sound events, sound parameters or playing helps, said special keys being mounted on said support and on said control handle in a grid order having a modular width at least nearly coincident to said main keys and having a maximum extension and compass located within the reach of all five fingers of the player's hand resting upon the control handle, a first fraction of said special keys directing repetition of notes or sounds being fingered on said main keys, a second fraction of said special keys directing control of percussion effects, and a third fraction of said special keys providing for the switching of preset types of sounds; and (e) electronic means for preparing said electrical signals of said control handle and said special keys for the control of sound parameters and control functions for a cooperation, alteration, supplementation and complementation of the electrical signals being produced through said main keys.

2. The invention of claim 1, wherein said control handle has bearing and guiding means which are constructed as a parallelogram guiding mechanism with bearing arms supported in a plurality of pivot bearings allowing simultaneous travelling motions in said x- and z-directions, said control handle having stop members which limit the action range of said control handle when contacting corresponding second stop members which are fixed on said support and springs which stabilize the unoperated positions of said control handle.

3. The invention of claim 2, wherein said bearing and guiding means have a stop arm secured to a supporting piece which is connected with said pivot bearings for tilting only in the z-direction thus serving for a movement of said stop arm unaffected by any simultaneous movement of said control handle in the x-direction and thus allowing for accurate conversion of the travel of said stop arm by said converter means and accurate conversion of different loads said stop arm transmits to said additional converter means when pressed thereagainst.

4. The invention of claim 3, wherein said converter means and said additional converter means are arranged to generate electric signals which control two different ranges of volume and/or timbre of tones or sounds played on said main keys, on the first fraction of said special keys or on the second fraction of said special keys.

5. The invention of claim 1, wherein said control handle has two substantially straight rests for the edges of a player's palm, said rests being located at the free ends of said held and guided elongated part of said control handle and different loads upon said rests being transmitted to said additional converter means.

6. The invention of claim 5, wherein the signals produced by said additional converter means control the timbre of tones or sounds which are generated by said main keys, by the first fraction of said special keys or by the second fraction of said special keys.

7. The invention of claim 1, wherein the movement of said control handle in said x-direction is converted by said converter means and said converter means has parts mounted on portions of said control handle which have a coupled movability in said z-direction but independent movability in said x-direction thus allowing for accurate conversion of movement of said control handle in said x-direction independently of simultaneous movement of said control handle in said z-direction.

8. The invention of claim 7, wherein the signals generated by said converter means control the pitch of tones or sounds being produced by said main keys, said first fraction of said special keys or said second fraction of said special keys.

9. The invention of claim 1, wherein said first fraction of said special keys allows for a direct control of the dynamic or non-dynamic attack and the duration and damping of tones or sounds being fingered on said main keys, and additionally allows for simultaneous selection of various sequential or parallel patterns of the addresses of tones, single tones or chords, said electronic means being arranged to process transformation and reorganization of said various patterns.

10. The invention of claim 1, wherein touching of one of said special keys activates said electronic means to transmit only the addresses of the tone degrees and restrict all other control signals of tones or sounds being played on said main keys.

11. The invention of claim 1, wherein said second fraction of said special keys is arranged to permit direct control of the dynamic or non-dynamic attack, the duration and the damping of percussion effects or noises.

12. The invention of claim 1, wherein a fourth fraction of said special keys initiates the activation of said electronic means to generate signals which control the pitch for a continuous or gradual variation mode.

* * * * *